US006810559B2

(12) United States Patent
Mertes et al.

(10) Patent No.: US 6,810,559 B2
(45) Date of Patent: Nov. 2, 2004

(54) AGITATOR ASSEMBLY FOR VACUUM CLEANER

(75) Inventors: Richard H. Mertes, Fairview Park, OH (US); Joseph P. Frantz, Solon, OH (US)

(73) Assignee: Superior Brush Company, Cleveland, OH (US)

( * ) Notice: Subject to any disclaimer, the term of this patent is extended or adjusted under 35 U.S.C. 154(b) by 0 days.

(21) Appl. No.: 10/375,747

(22) Filed: Feb. 26, 2003

(65) Prior Publication Data

US 2003/0159240 A1 Aug. 28, 2003

Related U.S. Application Data

(60) Provisional application No. 60/360,409, filed on Feb. 27, 2002.

(51) Int. Cl.[7] ..... A47L 5/30; A47L 9/04

(52) U.S. Cl. ..... 15/392; 15/179

(58) Field of Search ..... 15/179, 182, 183, 15/383, 389, 392

(56) References Cited

U.S. PATENT DOCUMENTS 2,734,211 A * 2/1956 Vance ..... 15/183
4,173,807 A * 11/1979 Maier ..... 15/179
5,495,634 A 3/1996 Brundula et al.
5,619,768 A 4/1997 Brundula et al.
5,727,276 A 3/1998 Brundula et al.
6,314,611 B1 * 11/2001 Sauers ..... 15/376

* cited by examiner

*Primary Examiner*—Terrence R. Till
(74) *Attorney, Agent, or Firm*—D. Peter Hochberg; Sean Mellino; Katherine R. Vieyra

(57) ABSTRACT

An agitator assembly for a vacuum cleaner comprises a dowel assembly with recesses at its opposite ends defined by outwardly inclined walls. Each recess has inwardly facing radial vanes, and a shaft end for holding the inner ring of a bearing assembly. End caps extend over the ends of the dowel, and each has a collar for holding the outer ring of the bearing assembly and an outer longitudinal wall for providing a dust shield. The rotating vanes create an air barrier to preclude dust from moving towards each bearing assembly, and the inclined walls of each recess direct dust tossed outwardly by centrifugal force out of the agitator assembly. The end caps and the walls defining each recess further define a labyrinth seal to keep dust from traveling to each bearing assembly.

22 Claims, 7 Drawing Sheets

AGITATOR ASSEMBLY FOR VACUUM CLEANER

This application claims benefit of U.S. Provisional Application No. 60/360,409, filed Feb. 27, 2002.

BACKGROUND OF THE INVENTION

1. Field of the Invention

This invention relates to an agitator assembly for a vacuum cleaner, and in particular to an agitator assembly having apparatus for preventing dust from contaminating the bearings of the assembly.

2. Description of the Prior Art

Agitator assemblies or brush roll assemblies for use in vacuum cleaners are well known in the art. An agitator assembly generally includes a wooden dowel which is configured to be driven by a belt or a gear train, and has tufts of bristles and/or beater bar elements projecting radially from the surface of the dowel for beating against the surface of a carpet to loosen dirt from the fibers of the carpet. The agitator assembly rotates on bearings or bushings, and one of the problems with agitator assemblies used in vacuum cleaners is that dust tends to collect in and contaminate the bearings or bushings, detracting from the free rotation of the agitator assembly and leading to damage to the bearings. One of the means for protecting the bearings from dust is the use of a labyrinth thread seal to protect the bearings from dust, as is shown, for example, in U.S. Pat. No. 5,373,603. However, labyrinth seals are not entirely effective in use. It is also known to use dust shields for covering the end of the dowel to inhibit the path of the flow of dust into the bearing; however, such dust shields are also not entirely effective. Most agitator assemblies are made from wood and require both time to shape the dowel and the added step of balancing to achieve rotational stability.

SUMMARY OF THE INVENTION

An object of the present invention is to provide an agitator assembly, which is rotated in a vacuum cleaner on a set of bearings, with means for preventing dust from contaminating the bearing.

Another object of the invention is to provide an agitator assembly for a vacuum cleaner which expels dust, which dust may otherwise have gotten in or near the bearings.

Still another object of the invention is to provide an agitator assembly which is balanced when it is made and does not require any subsequent rotational balancing.

A yet further object of the invention is to provide an agitator assembly which can be produced efficiently and economically while yielding a device of high operational quality.

A further object of the invention is to provide an agitator assembly for a vacuum cleaner which employs the movement of air generated by the rotation of a dowel assembly to keep dust from impairing the operation of the bearing assembly used in the agitator assembly.

An additional object is to provide a system for reducing or preventing dust from contaminating the bearing assembly in the agitator assembly of a vacuum cleaner which requires a small number of parts.

Still another object of the invention is to provide an agitator assembly from which threads and other fibers can be easily removed once they have been wound on the brush roll of the agitator assembly as it rotates.

Other objects should be apparent from the description to follow and from the appended claims.

The foregoing objects are achieved according to the preferred embodiment of the invention. Accordingly, a vacuum cleaner agitator or brush roll assembly is provided having a central shaft or pin on which is mounted a belt drive pulley for receiving the drive belt from a vacuum cleaner. The agitator assembly incorporates a dowel from which tufts of bristles extend radially to loosen dirt from the carpet fibers. The dowel having the extending tufts is referred to as a brush roll. The central shaft of the agitator assembly extends along the longitudinal axis of the dowel and is rotated about the axis with the dowel by the belt from the vacuum cleaner. The dowel has an indented or recessed portion at each of its ends which are configured in a truncated fashion with inclined walls extending radially outwardly from the innermost end of the walls to the respective ends of the dowel. A set of radial vanes extend inwardly from the inclined walls towards the longitudinal axis. An end cap or cover in the form of a hub is fixed in the vacuum cleaner to which the agitator assembly is mounted and extends over each end of the dowel and has a collar extending into the recess for fixedly engaging the outer ring of the ball bearing assembly. The collar surrounds the ball bearing assembly and forms part of a labyrinth seal as well as defining part of an air passageway. The shaft fixedly engages the inner ring of the ball bearing assembly. The inner surface of the collar is cylindrical in format to engage the outer ring of the ball bearing assembly, while the outer surface of the collar is inclined to be generally parallel with the vanes of the dowel. The end cap has surfaces which are perpendicular to the longitudinal axis of the agitator assembly and extend across each end of the dowel and have an outer longitudinally-extending cylindrical portion which extends over the outer diameter of the dowel. The end caps and the recessed ends of the dowel with the radial vanes form a centrifugal dust shield as discussed below.

The dowel assembly has a drive member such as a pulley which is generally parallel to the outer cylindrical surface of the dowel and is configured to be driven by the belt of the vacuum cleaner. The location of the latter member can be varied according to the type of vacuum cleaner in which the agitator assembly is to be used. When the belt of the vacuum cleaner is rotating, it in turn rotates the pulley, the shaft and dowel, which in turn rotates the inner ring of the ball bearing assembly but the outer ring of the bearing assembly and the end cap are stationary relative to the dowel assembly. Therefore, the shaft rotates the inner ring of the ball bearing assembly at opposite ends of the agitator assembly.

During rotation, there are two occurrences relating to dust. First, the rotation of the dowel and the vanes produces turbulent air in the space between the vanes at the ends of the dowel and the end cap; and the turbulent air acts as a barrier to prevent dust from flowing between the end cap and the vanes of the dowel, to prevent the dust from contaminating the bearings. The second occurrence is that any dust, which is near the bearings or in the space between the end cap and the dowel, is thrown outwardly by centrifugal force, and the inclined ramp of the undercut portion of the dowel and the outer inclined portion of the collar of the end cap cooperate to cause the dust or dirt which is thrown outwardly by centrifugal force to be forced from the agitator assembly, and away the vacuum cleaner. Thus, the vanes establish an air barrier to the dust, and centrifugal force moves any dirt or dust outwardly along the path established by the recess in the dowel and the end cap. As a result, any damage that could be caused by the dust is avoided.

The dowel assembly according to the invention is made from plastic rather than from wood, and is so designed that it can be fabricated in a rotationally stable form. The production of the dowel is fast, accurate, and does not require the additional step of balancing the unit as was required in the prior art using wooden agitator assemblies. Cutting channels extend along the outer surface of the dowel to enable the cutting and removal of threads and other fibers wound thereon.

DETAILED DESCRIPTION OF THE PREFERRED EMBODIMENT

Figure 1:
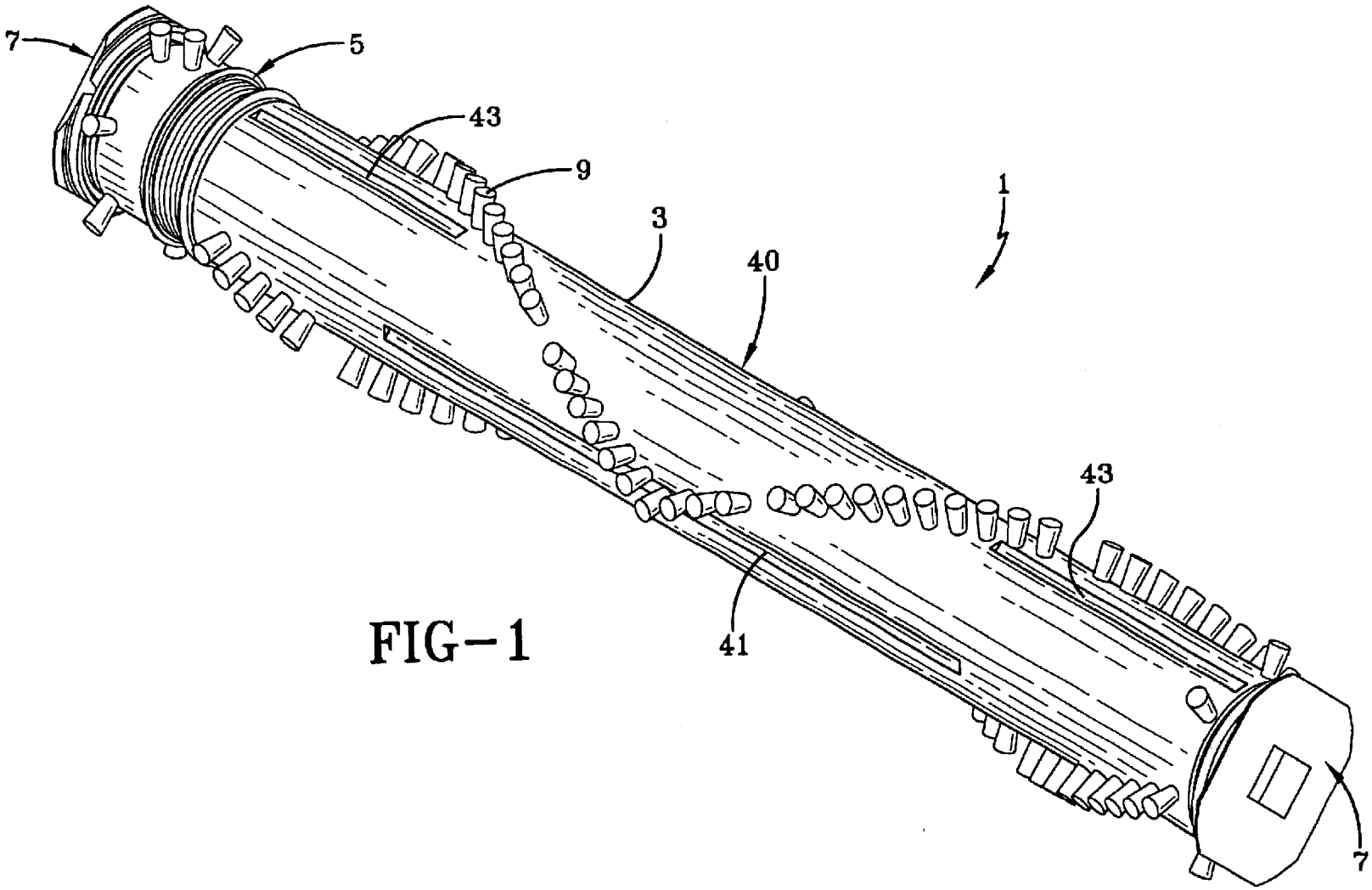
FIG. 1 is a perspective view of an agitator assembly according to the invention.

Turning first to FIG. 1, an agitator assembly 1 according to the preferred embodiment of the invention is shown. Agitator assembly 1 includes a dowel 3, to which is fixedly secured a belt-drive pulley 5 for enabling the agitator assembly to be rotated by the drive belt from a vacuum cleaner in which the agitator assembly 1 is mounted. Agitator assembly 1 further includes an end cap 7 which serves as a dust shield and bearing holder assembly, one of which being disposed at each end of dowel 3. Means are provided on the vacuum cleaner for fixedly securing the end cap 7 to the vacuum cleaner, so that the dowel is rotatable relative to the end cap and the outer ring of the bearing assembly fixed therein as described below. Drive pulley 5 could be disposed anywhere along dowel 3 according to the nature of the vacuum cleaner in which the agitator is to be installed. Drive pulley 5 could of course be replaced by other mechanical or electrical means depending on the drive apparatus of the vacuum cleaner. The surface of the pulley could be of any shape according to the type of belt or other drive mechanism. Tufts 9 of bristles extend outwardly from pockets in dowel 3 in a predetermined manner in order to dislodge dirt from carpets and other surfaces over which the agitator assembly is rotated by means of the vacuum cleaner in which it is installed. Tufts 9 could be held in dowel 3 by various means, such as by staples, bar anchors or fused in place.

Figure 2:
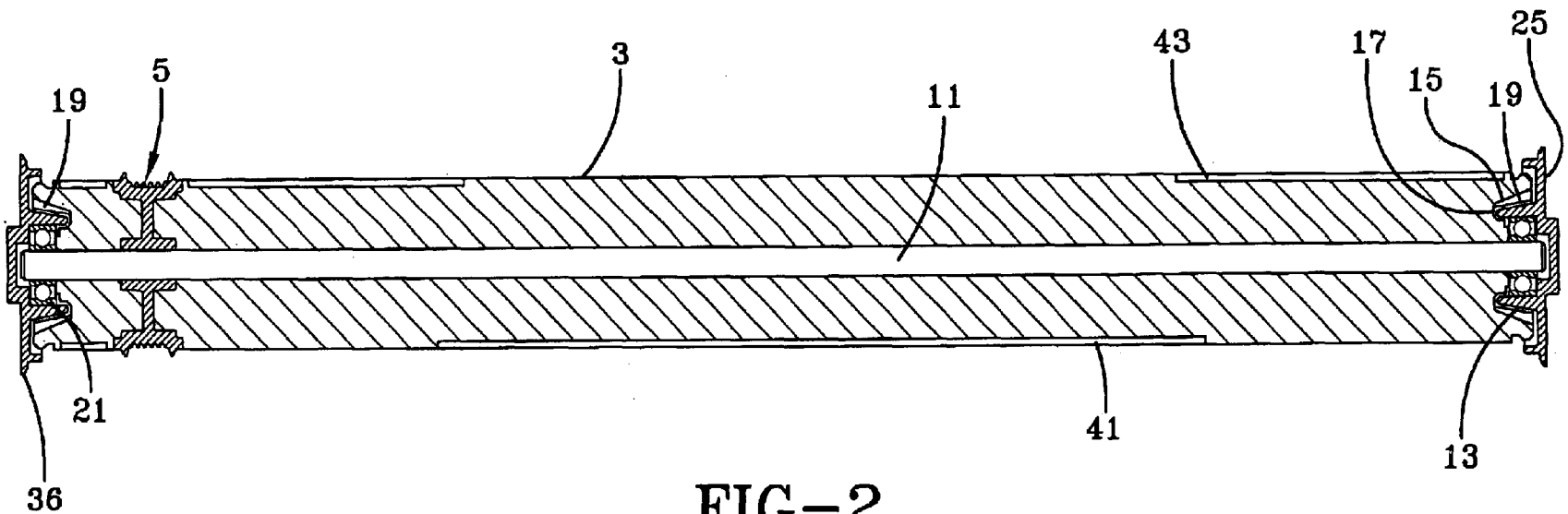
FIG. 2 is a cross-sectional view of the agitator assembly shown in FIG. 1 taken through the longitudinal axis of the agitator.
Figure 3:
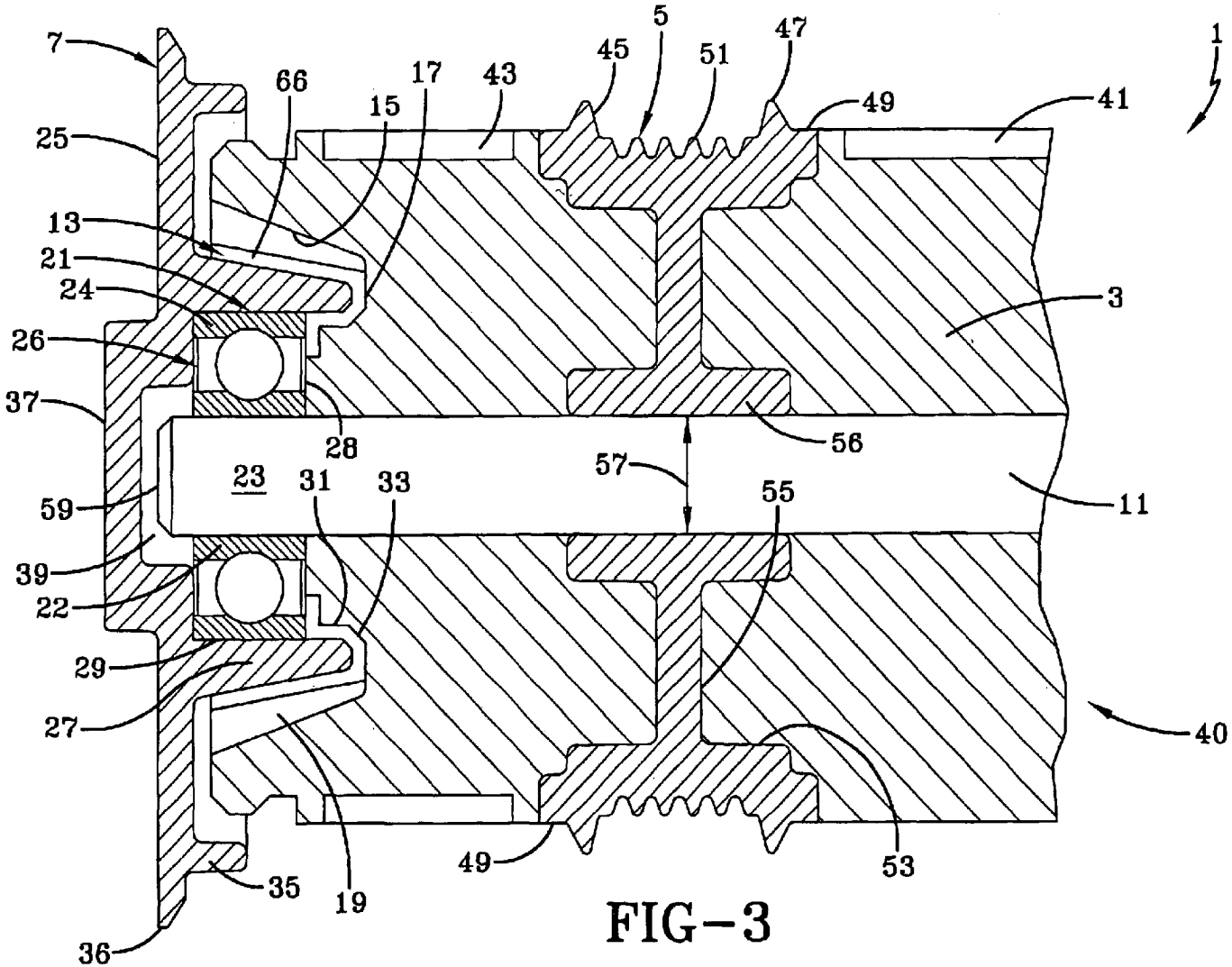
FIG. 3 is an enlarged portion of one end portion of the agitator assembly shown in the preceding figures.
Figure 5:
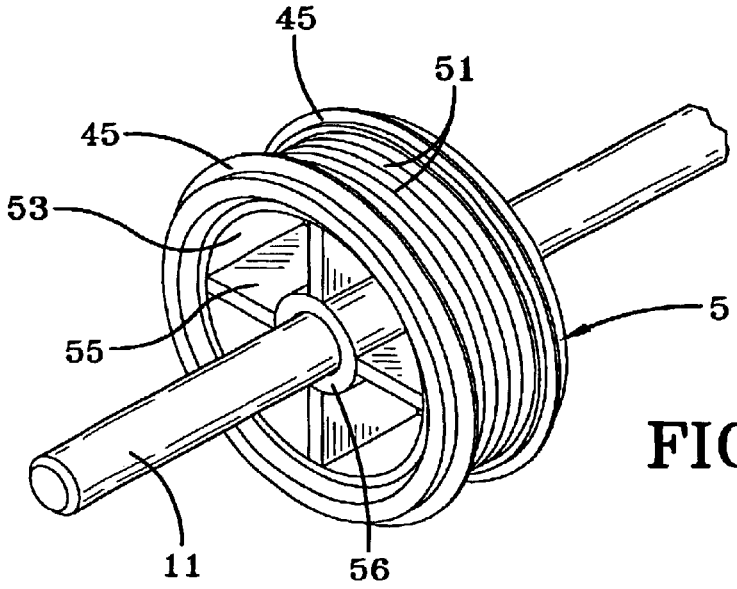
FIG. 5 shows the drive shaft with the belt-drive pulley in perspective form.

FIGS. 2 and 3 show the agitator assembly in greater detail. Dowel 3 is cylindrical in form, and is preferably made by injection molding. Dowel 3 could have other shapes, and could be made using other manufacturing techniques. Also, other materials such as wood or metal could be used and still incorporate the concepts of the present invention. As will be explained in further detail below, injection molding gives fast, uniform results and yields a product of even density which does not require rotational balancing. Rotational balancing is required in order for the agitator to continue to operate smoothly, uniformly and freely in response to the rotation of the belt drive of the vacuum cleaner. Belt-drive pulley 5 is produced separately, and is included during the injection molding of dowel 3 in a properly designed die. Belt-drive pulley 5 is also preferably made from plastic in an injection-molding machine. Various pulley designs to accommodate various drive belts, such as crowned, V-groove, lugs and the like, could be used in different vacuum cleaners with other types of belt drive systems. Appropriate plastics for the pulley include nylon, glass-filled nylon, ABS and the like. Metal pulleys may also be appropriate. Extending through dowel 3 is a drive shaft 11 to which dowel 3 and pulley 5 are fixed, so that the latter two members rotate as shaft 11 rotates. Shaft 11 is cylindrical in shape and is slightly tapered at its ends, as shown in FIG. 5 to be described below.

Referring to FIGS. 1–4 and 7, agitator assembly 1 is indented or recessed as shown in indentation, recess or depression 13 at its opposite ends and has an inclined side wall 15 defining the side of the depression. Side wall 15 is inclined inwardly starting from the end of dowel 3 and proceeding towards the interior of the dowel, or being inclined outwardly if one considers the depression beginning inside the dowel and extending towards the end of the dowel. The interior end of depression 13 is in part defined by a flat end wall 17 so that depression 13 is in general a truncated cone. Extending radially inwardly from wall 15 is a series of uniformly spaced multiple vanes 19 whose purpose is described below. As explained later with respect to FIG. 7, there are eight vanes 19 in agitator assembly 1. Inclined wall 15 is at the base of vanes 19.

Figure 8:
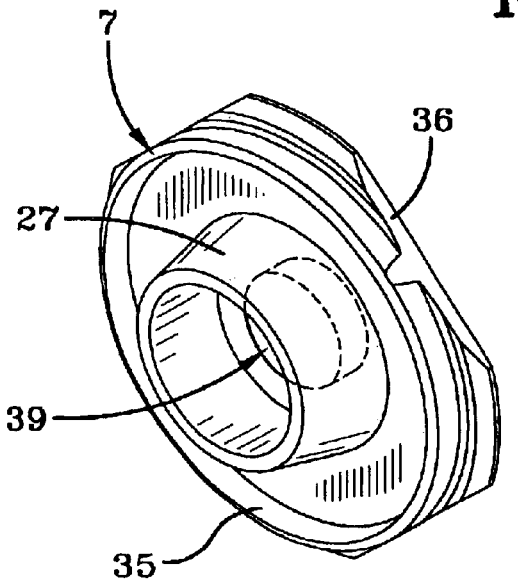
FIG. 8 is an enlarged, perspective view of the inside of the end cap.
Figure 9:
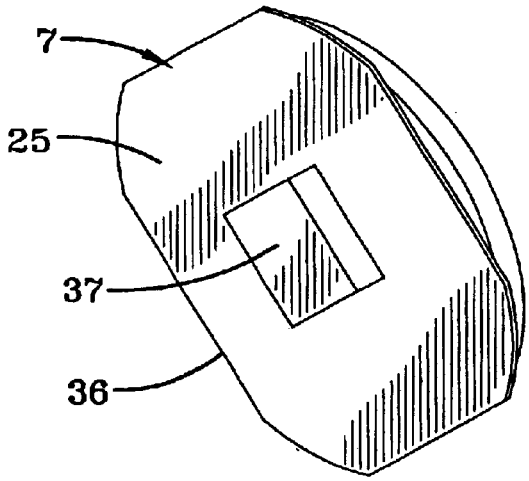
FIG. 9 is an enlarged, perspective view of the outside of the end cap.
Figure 10:
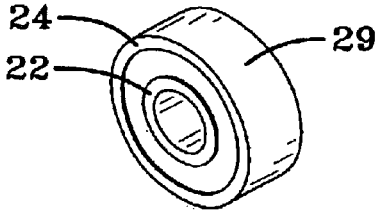
FIG. 10 is a perspective view of the ball bearing assembly.

There are ball bearing assemblies 21 at opposite ends of dowel 3 which engage on their interior surfaces the end portions 23 of drive shaft 11. This is shown most clearly in FIG. 3. Each ball bearing assembly 21 includes an inner ring or race 22 with an inner diameter generally equal to the outer diameter of shaft 11 so that ring 22 will rotate with shaft 11, an outer ring or race 24 with an outer diameter, and a set of ball bearings 26. Inner ring 22 rests on shoulder 28 of dowel 3. The ball bearing assembly is also shown in FIG. 10. As explained in further detail below, shaft 11, with dowel 3 and belt-drive pulley 5, rotates with respect to outer ring 24 of ball bearing assembly 21. It is very important to keep dust from contaminating ball bearing assembly 21, since otherwise shaft 11 and dowel 3 could not freely and uniformly rotate. In order to help assist in keeping dust from ball bearing assembly 21, an end cap 7 is provided. Referring to FIGS. 3, 8 and 9, end cap 7 includes a generally flat end portion 25 having an inwardly directed, generally cylindrical end wall or collar 27 ("inwardly" means towards dowel 3). Collar 27 has an interior bore generally equal to the outer diameter of the outer ring 24 which fixedly engages the outside surface 29 of ball bearing assembly 21. This can be accomplished during manufacture by a press-fit. Collar 27 extends inwardly beyond ball bearing assembly 21 into a pocket defined by an axial wall 31 and an inclined wall 33, which pocket terminates at wall 17 of dowel 3. The outside of collar 27 is inclined by the same amount as vanes 19, but collar 27 terminates in the radial direction prior to its entering into the space between vanes 19. Also extending inwardly from end cap 7 is an outer or exterior cylindrical wall 35 which is spaced radially from the end of dowel 3 as shown. End cap 7 is fixedly retained in the vacuum cleaner in which agitator assembly 1 is mounted. This is accomplished according to the end cap holding apparatus in the vacuum cleaner. An outside edge 36 or an edge of a protrusion 37 (discussed below) could be fixedly held by the vacuum cleaner to keep outer ring 24 fixed with respect to dowel 3 as the latter rotates. The combination of the shaft, the dowel, the outwardly extending tufts, the bearing assemblies and the end caps is referred to as the agitator assembly.

The outside of end cap 7, shown in FIG. 9, includes a square protrusion 37 having an inside recess 39 into which the end portion of shaft 23 extends. The end cap could be of any shape to accommodate being mounted in various housings specific to different customer designs.

As referred to herein, the term dowel assembly, referred to by numeral 40, includes dowel 3, pulley 5 and tufts 9. The ball bearing assembly can be considered part of dowel assembly 21 or end cap 7, since inner ring 22 is fixed on shaft 11 and outer ring 24 is fixed in end cap 7.

Disposed on dowel 3 is a first series of cutting channels 41 extending around the middle of dowel 3 and another set of cutting channels 43 extending around the end portions of dowel 3. These can be seen most clearly in FIGS. 1–4 and 6. As dowel assembly 40 rotates, it oftentimes picks up thread, yarn and other fibers, and they wind around dowel 3 and are difficult to simply grab onto and pull off; yet they must be removed in order to properly clean the vacuum cleaner and to keep the agitator assembly running freely and uniformly. Cutting channels 41 and 43 enable the user of a vacuum cleaner to insert scissors or some other cutting device into one of the channels 41 and into one of the channels 43 at both ends of agitator assembly 1 to cut the thread, yarn or other fiber, to enable it to be easily pulled from dowel 3. Cutting channels 41 and 43 could be grooves, such as radial grooves or slots, protruded surfaces or mounds, or a combination of grooves and protrusions. Different grooving arrangements covering the length of the dowel to avoid interfering with specific tuft patterns may be used.

Figure 11:
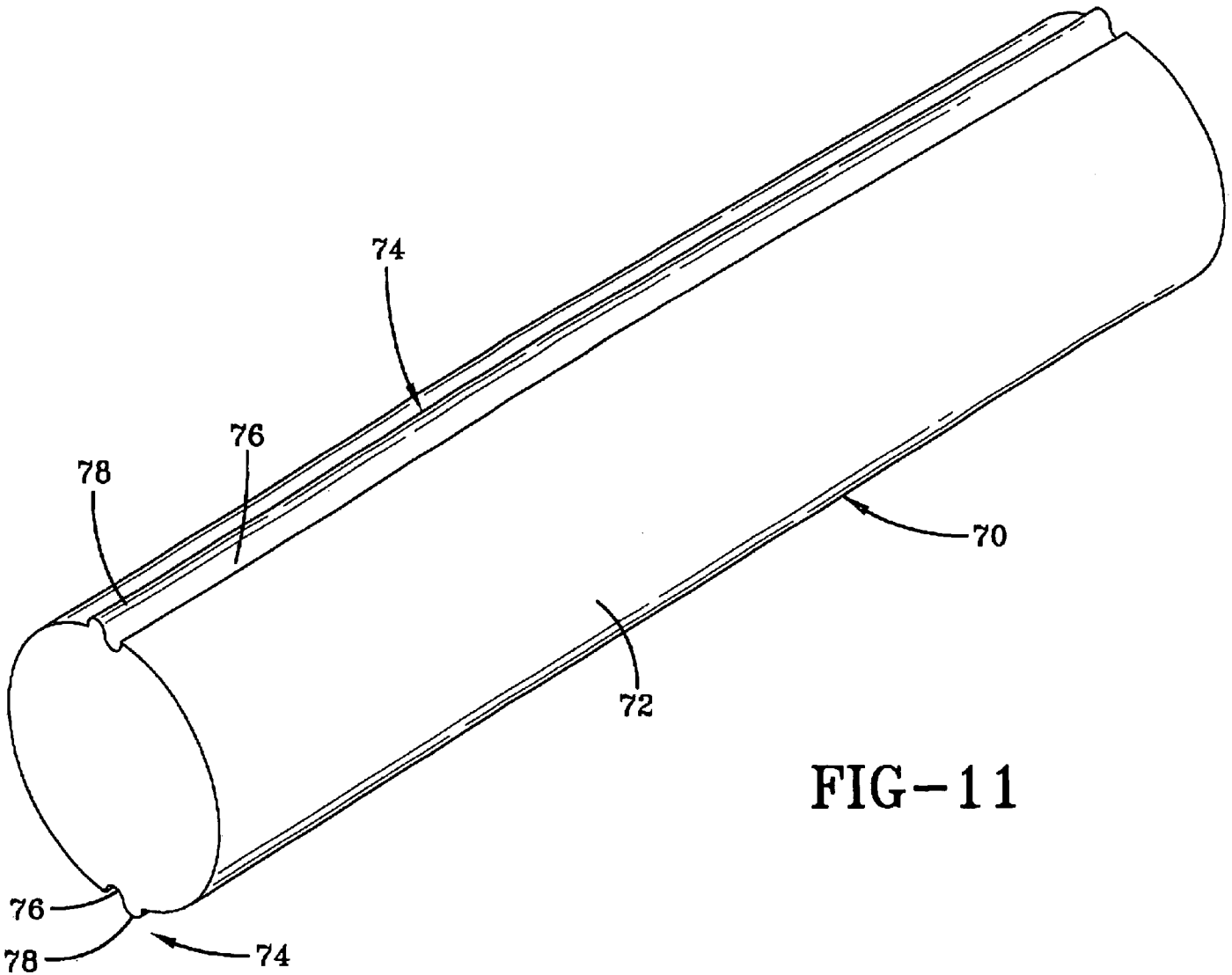
FIG. 11 is a perspective view of a dowel in simplified form with a modified surface.

Another device for use in removing threads and other flexible articles wound about a rotational dowel is shown in FIG. 11. FIG. 11 shows a dowel assembly 70 of the same type as dowel assembly 10, but with all of the details omitted for sake of clarity except for a pair of cutting arrangements 74 extending along a dowel 72. Each cutting arrangement 74 includes a channel 76 shown extending longitudinally along the surface of dowel 72, and a parallel and adjacent protrusion 78. The combination of the channel 76 and protrusion 78 exposes free portions of threads and other flexible articles wound about dowel 72, which can be easily cut by running a scissor blade, a knife blade or other cutting instrument along one of channels 76 or adjacent protrusion 78. Once cut, the material can be removed and discarded. Many variations are possible. Only one pair of a channel and a protrusion can be used. While the channel and protrusion are shown running in the longitudinal direction, they could follow a curved path, be provided in segments along dowel 72, or have other patterns. Either one or more channels, or one or more protrusions, could be used alone, spread apart from each other, or be used with other surface variations in dowel 72.

Belt-drive assembly 5 will now be described in greater detail. With reference to FIGS. 3 and 5, pulley 5 has a generally cylindrical exterior portion having a pair of parallel, cylindrical rails 45, which are generally V-shaped in configuration, having a wide base, and each terminating in a pointed apex 47. Disposed on the outermost portion of pulley 5 is a pair of cylindrical end portions 49 which terminate at the beginning of guide rails 45. A series of upwardly extending, V-shaped guides 51, which are concentric with guide rails 45 about the longitudinal axis of pulley 5 (which is coaxial with the axis of shaft 11 when mounted thereon), are provided for being engaged by the drive belt from the vacuum cleaner. The generally cylindrical portion of pulley 5 terminates at an interior cylindrical surface 53, and from which extend inwardly multiple radial support members or spokes 55 which terminate at a hub 56 having an inner diameter 57 which is about the same as the outer diameter of shaft 11. Four spokes 55 are shown. Of course, other numbers of spokes 55 could be used as well. During the assembly of agitator assembly 1, pulley 5 is press-fit on shaft 11 to hold it in place, as shown, for example, in FIG. 5.

As noted above, shaft 11 is cylindrical in form having tapered ends shown at 59 in FIG. 3. Shaft 11 is preferably made from an appropriate steel or aluminum member.

Figure 4:
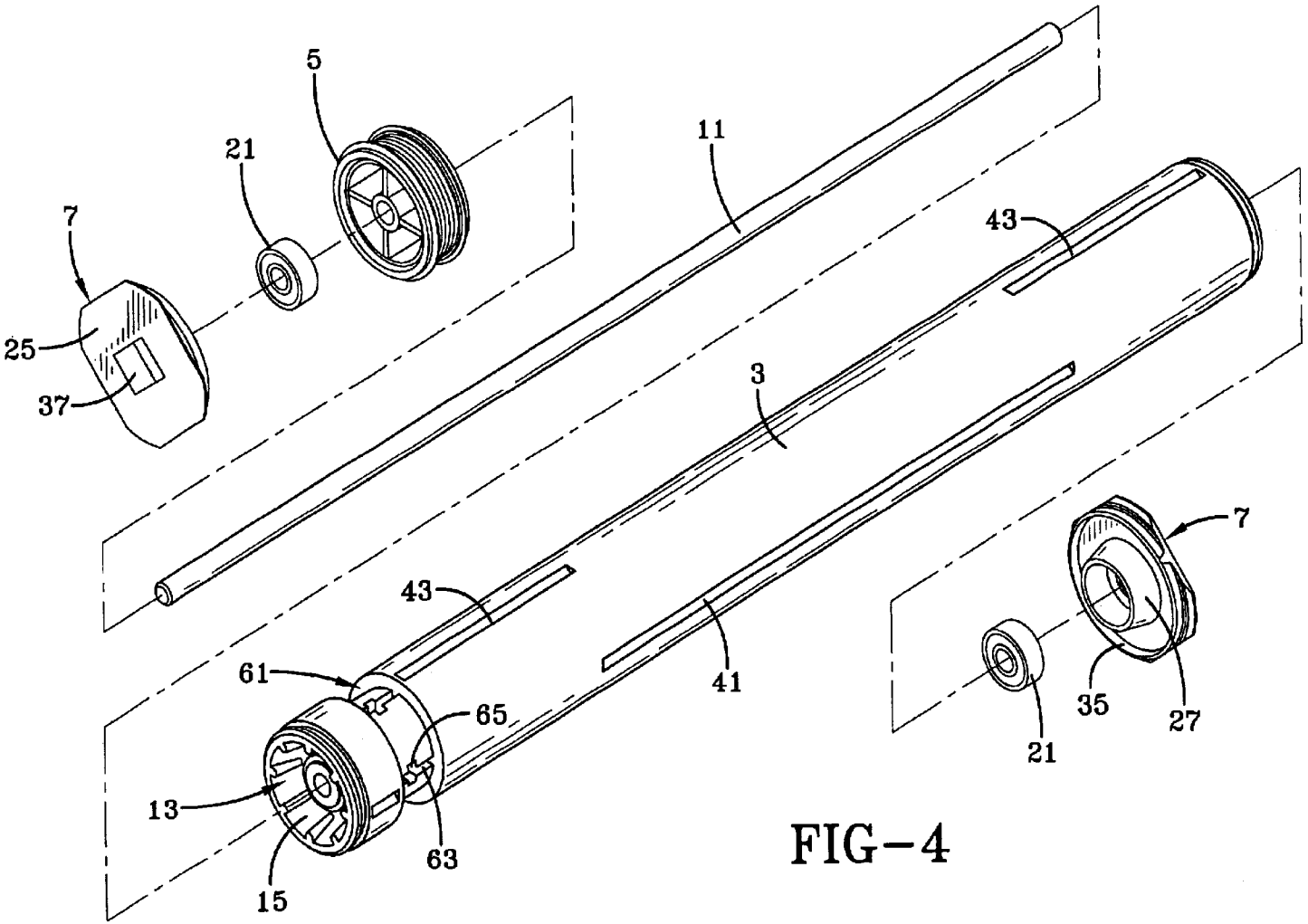
FIG. 4 shows the agitator assembly in exploded form.
Figure 6:
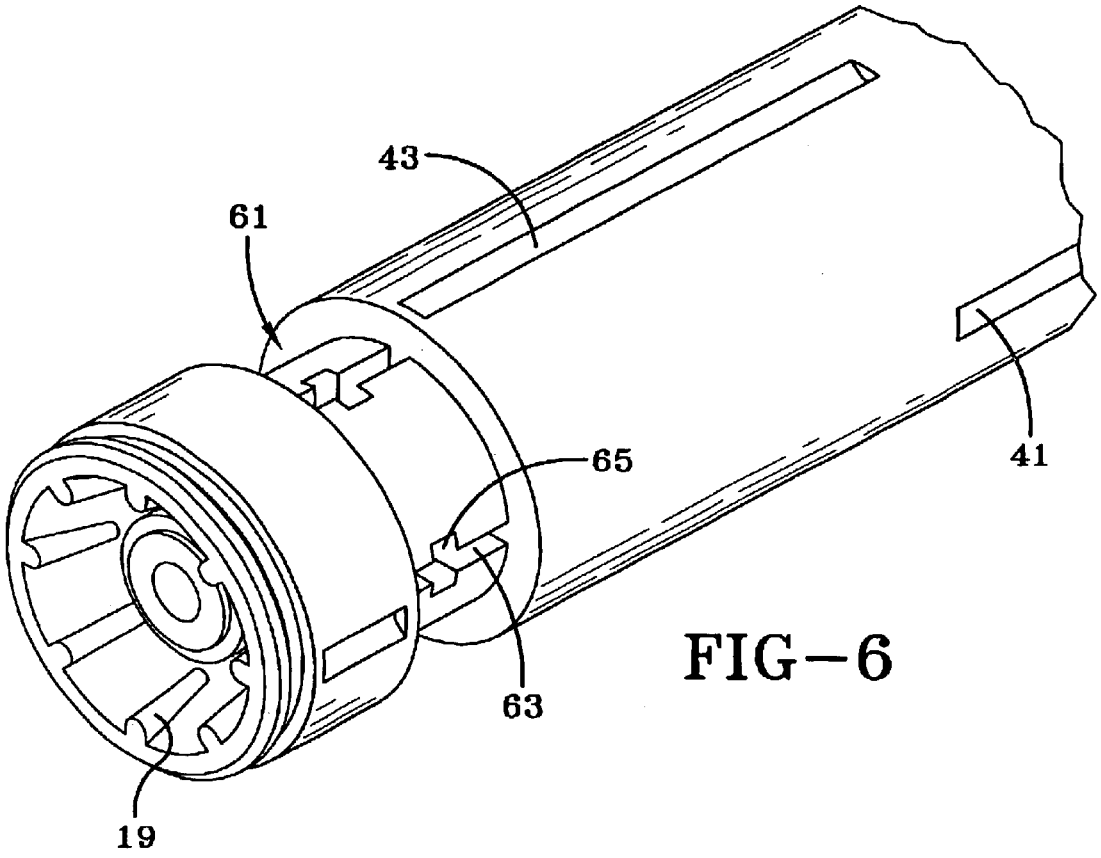
FIG. 6 shows the end of the dowel in enlarged form.
Figure 7:
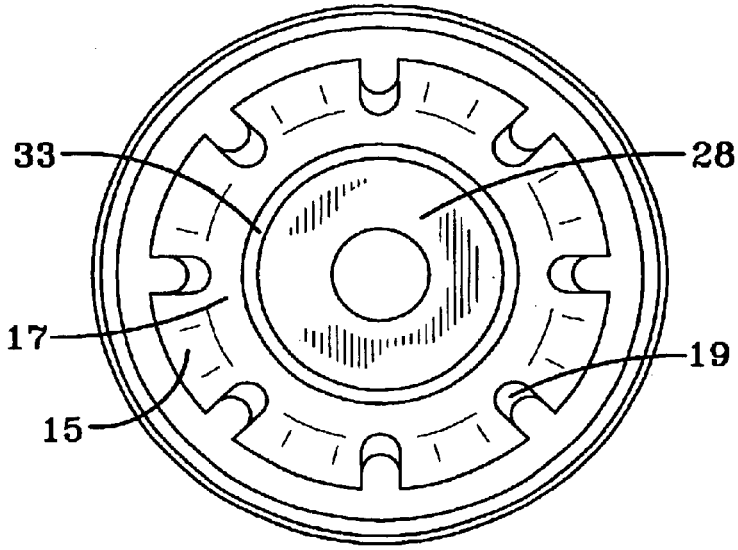
FIG. 7 is an enlarged end view of the dowel.

With further reference to dowel 3, an annular indented portion 61 is shown in FIGS. 4 and 6. This portion has longitudinal slots 63 having at their midpoint transverse, radial slots 65. These are the recesses in which the spokes from pulley 5 extend, the pulley having been removed to enable a clear explanation of the embodiment.

As noted above, the opposite ends of dowel 3 have a set of inclined vanes 19. These vanes cooperate with collar 27 of dust shield and bearing assembly holder 7 to provide a very important purpose of the present invention.

Turning again to FIG. 3, a belt from a vacuum cleaner engages belt-drive pulley 5 to rotate dowel assembly 40 which comprises shaft 11, dowel 3 and pulley 5. Vanes 19 rotate about cylindrical collar 27 and outer ring 24 of bearing assembly 21 at both ends of the agitator assembly. This rotation causes air turbulence to occur in a cavity 66 which runs from the inner edge of bearing assembly 21, around the inner portion of collar 27 to its termination at the inside edge of end cap 7. This turbulence provides a barrier to dust which otherwise could flow through the cavity and contaminate bearing assembly 21. Moreover, any dust which happened to be in or around bearing assembly 21 would be thrown outwardly by centrifugal force. Centrifugal force would cause the dust to move parallel to the inclined surface 15 to the gap between the respective ends of dowel 3 and the inner surface of dust cap and bearing assembly holder 7. The dust would then be forced around the outer wall 35 and away from bearing assembly 21.

The invention thus provides an extremely efficient agitator assembly which can be made using normal manufacturing techniques, particularly with injection molding. An extremely effective yet economical provision is made for protecting the bearings from dust contamination. The parts can be made faster than with the former wooden dowels, would not require the rotational balancing which had been required for wood dowels, enables the uniform and fast assembly of the tuft bristles, and belt-drive pulley as discussed above. Since the parts are made from plastic, they can be made in a variety of colors to render the unit attractive as well. The plastic should be hard and durable, and types of polypropylene should be appropriate.

Even though injection molded plastic has been found very useful for components of the preferred embodiment of the invention described above, in some instances wood, metal, glass or plastic other than injection-molded plastic might prove preferable while still incorporating the present invention. A beater bar could be made in a molding process as an integral part of the molded dowel if desired. The surface of the dowel could be smooth or textured. Moreover, the inventive concepts described herein could be used on wet-back cleaning machines, such as steam cleaners, shampooers and wet vacuum cleaners.

The invention has been described in detail, with particular emphasis on the preferred embodiment thereof, but variations and modifications may occur to those skilled in the art to which the invention pertains.

What is claimed is:

1. An agitator assembly for a vacuum cleaner, said agitator assembly comprising:

an end cap for being fixed relative to the vacuum cleaner and including a first portion of a bearing assembly fixed relative to said end cap, said end cap blocking dust from traveling to said bearing assembly; and a dowel assembly having a longitudinal axis and for being rotated about the longitudinal axis by the vacuum cleaner, said dowel assembly comprising:

a dowel having an end portion for fixedly holding a second portion of said bearing assembly;

apparatus extending from said dowel for agitating the surface of carpeting and other flooring to loosen dirt and render the dirt subject to cleaning by the vacuum cleaner in response to rotation of said dowel assembly; and a structure for establishing air turbulence in a path transverse to the longitudinal axis of said dowel for evicting dust from said bearing assembly and for impeding the flow of dust to said bearing assembly.

2. An agitator assembly according to claim 1, and further including at least one protrusion extending along at least part of the length of the dowel for enabling the use of a cutting implement to cut free portions of materials wound about said dowel.

3. An agitator assembly according to claim 1 wherein said transverse path is inclined with respect to said longitudinal axis.

4. An agitator assembly according to claim 1 wherein said structure for establishing air turbulence in a path transverse to the longitudinal axis of said dowel comprises a set of vanes extending inwardly from an interior surface of said dowel assembly.

5. An agitator assembly according to claim 4 wherein said dowel has walls defining said interior surface, said interior surface comprising a truncated recess extending from the end portion of the dowel, and said set of vanes extends from said walls.

6. An agitator assembly according to claim 5 and further including a collar extending from said end cap for cooperating with said set of vanes to define an air passageway.

7. An agitator assembly for use with a vacuum cleaner, the vacuum cleaner having rotating apparatus for rotating a part of said agitator assembly, said agitator assembly comprising:

a dowel assembly with a longitudinal axis, said dowel assembly comprising:

a driven apparatus for cooperating with the rotating apparatus of the vacuum cleaner to rotate said dowel assembly about the longitudinal axis;

a surface defining a receptacle in at least one of the ends of said dowel assembly;

a first portion of a bearing assembly in said receptacle;

airflow structure extending into said receptacle for creating an airflow barrier to dust entering said receptacle in response to the rotation a said dowel assembly; and a surface for receiving dust particles in said receptacle in response to centrifugal force imparted to the dust particles in response to the rotation of said dowel assembly and for directing the dust particles out of said receptacle; and an end cap for impeding the movement of dust into said bearing assembly and for supporting said bearing assembly in partially-fixed relationship with the vacuum, said dust shield and bearing-holding apparatus comprising:

a second portion of said bearing assembly;

an insert for extending into said receptacle for holding said second portion of said bearing assembly in a fixed relationship with respect to the vacuum cleaner, said dowel assembly being rotatable about the longitudinal axis with respect to said insert and said second portion of said bearing assembly held by said insert;

a surface extending into said receptacle for creating a labyrinth seal in said receptacle to impede the movement of dust through said receptacle to said bearing assembly; and a wall for extending around the end of said dowel assembly for impeding the movement of dust particles into said receptacle.

8. An agitator assembly according to claim 7 wherein said driven apparatus comprises a pulley located on said dowel assembly and having an axis of rotation coincident with the longitudinal axis of said dowel assembly, said pulley capable of being rotated by a drive mechanism of the vacuum cleaner.

9. An agitator assembly according to claim 7 wherein said receptacle is generally in the shape of a truncated cone, and said surface for receiving dust particles comprises an inclined surface in said dowel assembly defining a portion of said receptacle, said inclined surface directing dust particles from said receptacle resulting from centrifugal force imparted to the dust particles.

10. An agitator assembly according to claim 7 wherein said airflow structure comprises a set of vanes extending from said surface defining said receptacle towards the longitudinal axis, said vanes establishing the airflow in said receptacle in response to the rotation of said dowel assembly.

11. An agitator assembly according to claim 7 wherein said airflow structure comprises a set of vanes extending from said surface defining said receptacle towards the longitudinal axis.

12. An agitator assembly according to claim 11 wherein said vanes are uniformly spaced angularly about the longitudinal axis.

13. An agitator assembly according to claim 7 wherein said dowel assembly further includes:

a shaft extending along the longitudinal axis of said dowel assembly and including an end portion for fixedly engaging the inner surface of said bearing assembly whereby the portion of said bearing assembly including said engaged inner surface rotates with the dowel assembly.

14. An agitator assembly according to claim 7 wherein said end cap comprises:

an end portion extending over the end of said dowel assembly and generally perpendicular to the longitudinal axis;

a collar concentric with the longitudinal axis and extending into said recess, said collar comprising:

an inner wall having an inner surface concentric with the longitudinal axis and for fixedly engaging the second portion of said bearing assembly, said collar cooperating with said surface defining said receptacle to define a labyrinth to impede the flow of dust particles to said bearing assembly; and an outer wall spaced from said airflow structure and bearing assembly to enable the rotation of said dowel assembly relative to said collar.

15. An agitator assembly according to claim 14 wherein said end cap further comprising an exterior wall extending around the end of said dowel assembly and having an inner surface facing the longitudinal axis for cooperating with said dowel assembly to define a portion of said labyrinth.

16. An agitator assembly according to claim 7 wherein said dowel assembly further comprises:

a dowel having a longitudinal axis coincident with the longitudinal axis of said dowel assembly;

tufts of bristles extending from said dowel for dislodging dirt from carpets and other surfaces in response to the rotation of said dowel adjacent to the carpet and other surfaces; and cutting channels along said dowel for enabling the insertion of a cutting implement into said channels to enable the cutting of fibrous materials wound about said dowel resulting from the rotation of said dowel near the fibrous materials.

17. An agitator assembly according to claim 16 wherein said dowel is made from hard plastic.

18. An agitator assembly according to claim 7 wherein said dowel further comprises:

a cutting channel extending along the outer surface of the dowel; and a protrusion extending along the outer surface of the dowel and adjacent to the cutting channel;

wherein said cutting channel and protrusion enable the use of a cutting implement to cut materials wound about said dowel.

19. An agitator assembly for use with a vacuum cleaner, said agitator assembly comprising:

a dowel assembly having a longitudinal axis, said dowel assembly comprising:

a shaft extending along the longitudinal axis;

a generally cylindrical dowel fixed on said shaft, said shaft extending from both ends of said dowel;

a pulley fixedly mounted on said dowel and being concentric with the longitudinal axis;

surfaces defining recesses at opposite ends of said dowel, said recesses being in the general shape of a truncated cone, tapering inwardly from the end of said dowel towards the interior of said dowel; and a set of vanes extending from said surfaces defining each of said recesses to, and equally spaced around, the longitudinal axis; and an end cap for each end of said dowel, said end cap comprising:

an end portion extending over the end of said dowel;

a collar extending into said recess, said collar having an inclined outer dimension spaced from said set of vanes, and an inner diameter; and an outer cylindrical wall extending partly over the end of said dowel to impede the flow of dust into said recesses; and a ball bearing assembly having an inner ring with an inner diameter for fixedly engaging said shaft for rotation in response to the rotation of said shaft, and an outer ring with an outer diameter for fixedly engaging the inner diameter of said collar and for remaining stationary relative to said dowel assembly during rotation of said dowel assembly;

said collar cooperating with said dowel to define a space for turbulent air created by said set of vanes in response to the rotation of said dowel assembly to form a barrier to dust particles and to define a path for dust particles out of said agitator assembly when impacted with centrifugal force from the rotation of said dowel assembly.

20. A dowel assembly for use with an agitator assembly for a vacuum cleaner, said dowel assembly comprising:

a dowel; and at least one channel and at least one protrusion extending adjacent each other along at least part of the length of the dowel for enabling the use of a cutting implement to cut free portions of materials wound about said dowel.

21. A dowel assembly according to claim 20 wherein at least one of said channels and said protrusions are selected from the group consisting of segmented and continuous configurations.

22. A dowel assembly according to claim 20 wherein at least one of said channels and said protrusions are selected from the group consisting of straight and helical configurations.

* * * * *